US005191877A

United States Patent [19]

Shimek et al.

[11] Patent Number: 5,191,877

[45] Date of Patent: Mar. 9, 1993

[54] INSERTABLE GAS CONVERSION UNIT

[76] Inventors: Ronald J. Shimek, 8944 W. 154th St., Prior Lake, Minn. 55372; Daniel C. Shimek, 5260 W. 132d St., Apple Valley, Minn. 55124

[21] Appl. No.: 751,510

[22] Filed: Aug. 29, 1991

[51] Int. Cl.[5] ..... F24C 3/00

[52] U.S. Cl. ..... 126/512; 126/515; 126/528; 126/530; 126/547; 126/82

[58] Field of Search ..... 126/512, 515, 528, 529, 126/530, 547, 82

[56] References Cited

U.S. PATENT DOCUMENTS

| | | | |
|---|---|---|---|
| 1,208,974 | 12/1916 | Jensen et al. | 126/530 |
| 3,601,117 | 8/1971 | Carson | 126/515 |
| 4,191,162 | 3/1980 | Simms | 126/529 |
| 4,230,092 | 10/1980 | Henriques | 126/529 |
| 4,793,322 | 12/1988 | Shimek et al. | 126/512 |
| 4,924,850 | 5/1990 | Reiger | 126/500 |

*Primary Examiner*—Carroll B. Dority
*Attorney, Agent, or Firm*—John B. Sowell

[57] ABSTRACT

An insertable gas conversion unit for insertion into existing wood burning fireplaces comprises an insertable gas fireplace conversion unit having a fire box combustion chamber and a gas burner mounted therein. The combustion chamber is covered with a decorative glass door. The conversion unit comprises a first coupling unit which is connected to the chimney of the exhaust outlet of the existing fireplace and further comprises a second coupling unit which is connected to the exhaust gas outlet of said fire box of said conversion unit. Said first and second coupling units telescopically fit one into the other during the assembly and insertion of the gas fireplace unit in the existing wood burning fireplace so as to provide a gas fireplace conversion of a wood burning fireplace without requiring any custom fitting or parts.

18 Claims, 4 Drawing Sheets

INSERTABLE GAS CONVERSION UNIT

BACKGROUND OF THE INVENTION

1. Field of the Invention

The present invention relates to integrated prefabricated gas fireplaces with gas burners which are adapted to be inserted in existing prefabricated fireplaces that were designed to burn wood. More particularly, the present invention relates to a complete gas fireplace conversion kit that can be installed in existing zero clearance or masonry fireplaces in a minimum of time and expense to meet all code requirements as well as providing a high efficiency gas heating system.

2. Description of the Prior Art

The latest Clean Air Act mandates pollution standards for wood burning fireplaces and stoves. In addition to the federal clean air standards that become more stringent and difficult to meet over a period of years, state and local area codes have become and are becoming even tighter and more stringent than the federal law which is now defined in the Safety and Environmental Standards set forth in EPA Phase II 1991. In many western and midwestern cities such as Fresno California, Reno Nevada, Denver Colorado and numerous other local communities there have been promulgated standards that cannot be met by all existing wood burning zero clearance fireplaces and most wood burning stoves. The owners of such fireplaces and stoves now number in the tens of millions and are faced with having to abandon their fireplaces or buying gas burners for use in the fireplaces and/or buying gas log burners all of which are highly inefficient. Some owners are waiting for a conversion unit which will give them a high efficiency gas heating system which also meets all federal and local mandate requirements.

Heretofore, Heat-N-Glo of Savage, Minnesota has designed and sold prefabricated gas fireplace insert units or conversion kits for old and new conventional masonry fireplaces. These insert units were sold under Model Nos. 4000 IN and 4000 INC which included gas log burners with room air circulation blowers and semi-airtight front glass panels. Such units were not acceptable or adaptable for use in zero clearance fireplaces and would require custom adaptation of such units that cannot be carried out by field installation crews.

Our U.S. Pat. No. 4,793,322 issued Dec. 27, 1988 for a Direct-Vented Gas Fireplace. This zero clearance fireplace was designed for original installations and has provided the industry with a highly efficient gas burner that meets and/or exceeds all known pollution standards and incorporates an efficient heat exchanger as well as a fixed airtight front glass panel.

Neither of the two aforementioned gas fireplaces can be used as conversion units for existing wood burning zero clearance fireplaces without completely removing the installed zero clearance wood burning fireplace and installing one of the above mentioned gas fireplaces units in its place.

Therefore, it would be extremely desirable to provide a novel high efficiency gas fireplace gas burner unit that could be inserted into existing zero clearance wood burning fireplaces without any custom modification to provide a gas conversion fireplace unit.

SUMMARY OF THE INVENTION

It is a primary object of the present invention to provide a gas fireplace conversion unit that connects into an existing wood burning fireplace without custom modification.

It is another principal object of the present invention to provide a gas fireplace conversion unit which is removable after installation to convert back to a wood burning fireplace.

It is another principal object of the present invention to convert zero clearance wood burning fireplaces having Class A chimneys without having to employ a chimney insert liner.

It is another principal object of the present invention to provide a gas fireplace conversion unit for converting old masonry fireplaces with gas burner units employing expanded insert chimney liners.

It is another primary object of the present invention to provide a novel gas conversion unit for wood burning or inefficient gas burning fireplaces having chimney liners.

It is another primary object of the present invention to provide a novel gas fireplace and burner insert unit for gas conversion of existing zero clearance wood burning fireplaces.

It is another object of the present invention to provide a novel gas fireplace and burner insert unit for insertion into the combustion chamber area of existing zero clearance wood burning fireplaces.

It is another object of the present invention to provide a novel gas fireplace and burner unit for wood burning fireplaces that comprises a gas burner insert, a draft diverter conversion unit and a novel decorative air bleed shroud.

In accordance with these and other objects of the present invention, there is provided a novel gas conversion fireplace unit, a novel draft diverter coupling unit and a novel decorative air bleed shroud which are installable as a kit in existing zero clearance wood burning fireplaces without any custom modification.

DESCRIPTION OF THE PREFERRED EMBODIMENT

Figure 1:
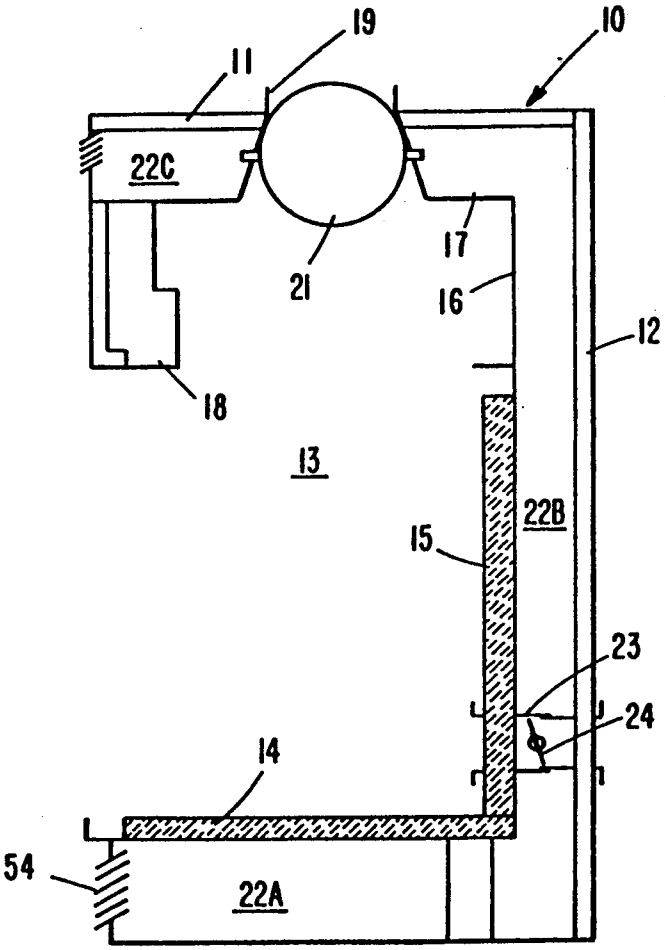
Figure 1 (Prior Art)
FIG. 1 is a schematic drawing in cross section and in side elevation of a typical prior art zero clearance wood burning fireplace before conversion to gas.

Refer now to FIG. 1 showing a typical prior art zero clearance wood burning fireplace 10 which is provided with an insulated top wall 11 and an insulated back wall 12. The combustion chamber 13 is provided with a bottom wall having refractory material 14 and a back wall 15 having a refractory material for insulation. The back wall 16 of the combustion chamber 13 is connected to the top wall 17 and the smoke diverter 18 is connected to the top wall 17. A chimney adapter 19 is shown having a damper 21 inserted therein. In this particular prior art example, a heat exchanger is provided by bottom passageway 22A, vertical back passageway 22B and top horizontal passageway 22C. Some such prior art zero clearance fireplaces are provided with blowers in the heat exchangers and some such zero clearance fireplaces have no heat exchanger and are referred to as non-circulating clean face fireplaces. Most national codes now require a source of fresh outside air to be used for combustion. The fireplace of FIG. 1 is shown having a fresh air inlet 23 having a damper 24 therein. When such fireplace is in use, the damper 24 is always open.

Figure 2:
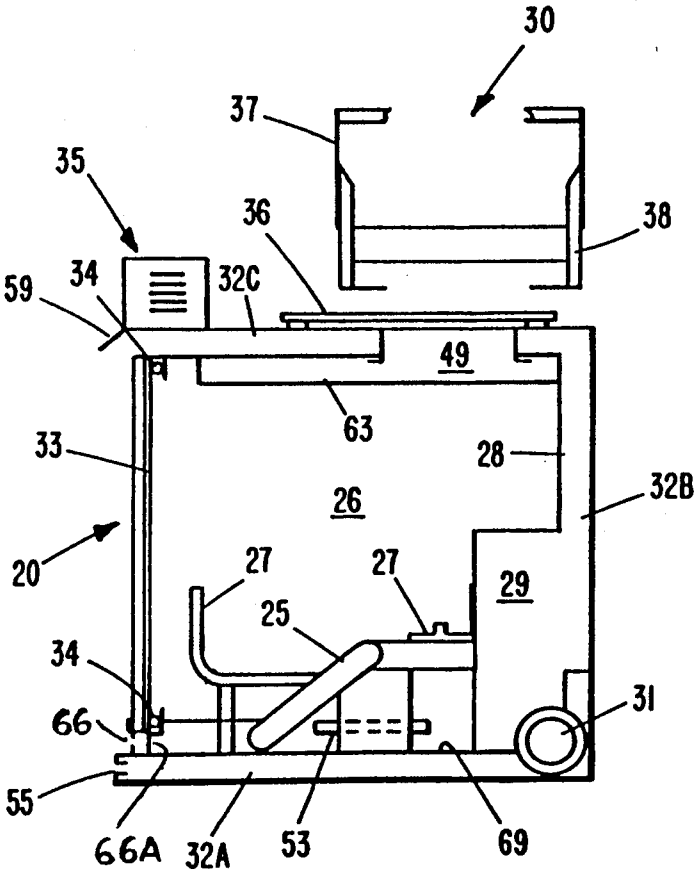
FIG. 2 is a schematic drawing in cross section and in side elevation of the present invention insertable gas conversion kit.

Refer now to FIG. 2 showing in cross section and side elevation a preferred embodiment of the present invention gas conversion unit 20 and its associated down draft diverter conversion unit 30 which will be coupled together inside the combustion chamber of the prior art zero clearance wood burning fireplace shown in FIG. 1. The gas conversion unit 20 comprises a gas burner 25 which is mounted in the combustion chamber portion of the conversion unit and is provided with a grate 27 for supporting decorative gas logs (not shown). The back wall 28 of the conversion unit 20 comprises a plenum 29 in which a circulating air blower 31 is mounted. Thus the heat exchanger including the circulating air blower 31 now comprises the passageways 32A, 32B and 32C. In the preferred embodiment of the present invention a ceramic glass panel 33 is mounted against the front face of the gas conversion unit and sealed semi-tight thereto by means of fiber glass rope 34 and clamps. Also mounted on the front face of the gas conversion unit 20 is a decorative air bleed shroud 35 which is removed to provide access to the down draft diverter 30 during installation of the gas conversion unit 20. A pair of long rectangular slide guides 36 are mounted on the top panel of the conversion unit 20 and provide means for slidably attaching the novel down draft diverter conversion unit 30. The diverter, unit 30 is preferably made in two cylindrical or rectangular prefabricated parts or portions 37 and 38.

Figure 3:
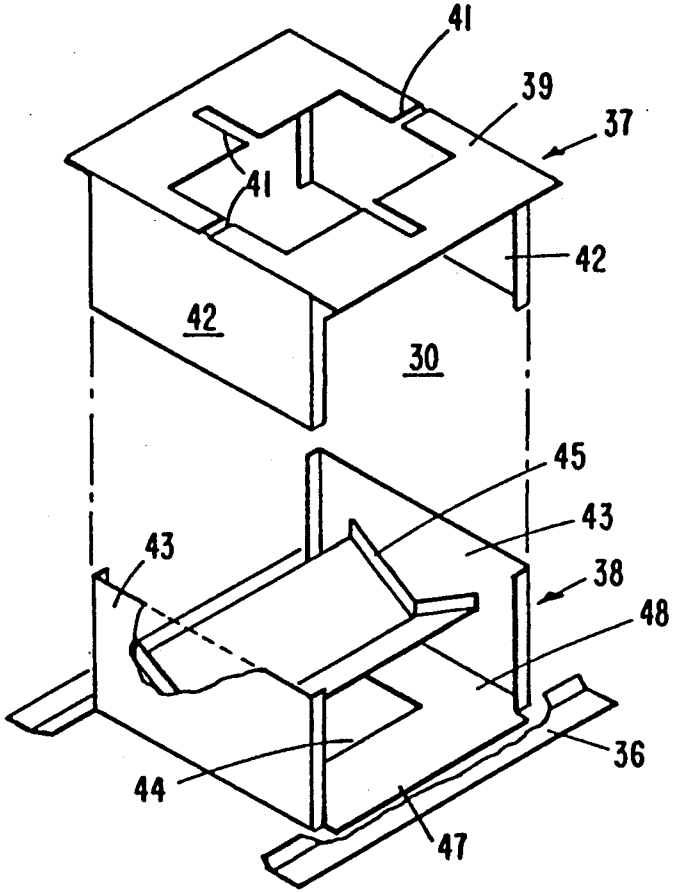
FIG. 3 is an enlarged isometric view of the novel draft diverter coupler that connects the top of the prior art fireplace chimney to the exhaust outlet of the gas conversion kit or unit without a custom modification.

Refer now to FIG. 3 showing an enlarged isometric view of the novel draft diverter conversion unit 30 which couples the top of the prior art fireplace and chimney to the top panel or exhaust outlet of the gas conversion unit 20. The upper portion 37 of the diverter unit 30 comprises a horizontal flange portion 39 having damper slots 41 therein. Upper portion 37 is provided with two downward extending vertical guide flanges 42 which nest around the upward extending vertical guide flanges 43 of the lower portion 38. Lower portion 38 is provided with a horizontal flat plate portion 48 which telescopingly interconnects the upward extending vertical guide flanges 43 and is provided with an exhaust aperture 44 therein which fits over the exhaust stack of the gas conversion unit 20 when mounted in its proper place. The upward extending flanges 43 also support a V-shaped diverter plate 45 which is mounted therebetween over the exhaust aperture 44. It will be appreciated that most fireplaces of the type under discussion must be provided with a down draft diverter of the type shown as diverter 45. However, most prefabricated fireplaces include such damper diverters in the top wall or top portion of the fireplace itself thus extending the height of the outer wall or reducing the size of the combustion chambers 26 and 13. By placing the diverter on top of the gas conversion unit 20, the combustion chamber 26 is made larger and more efficient. The telescopic coupling and conversion means in the form of the novel down draft diverter conversion unit 30 also permits ease of installation.

Figure 4:
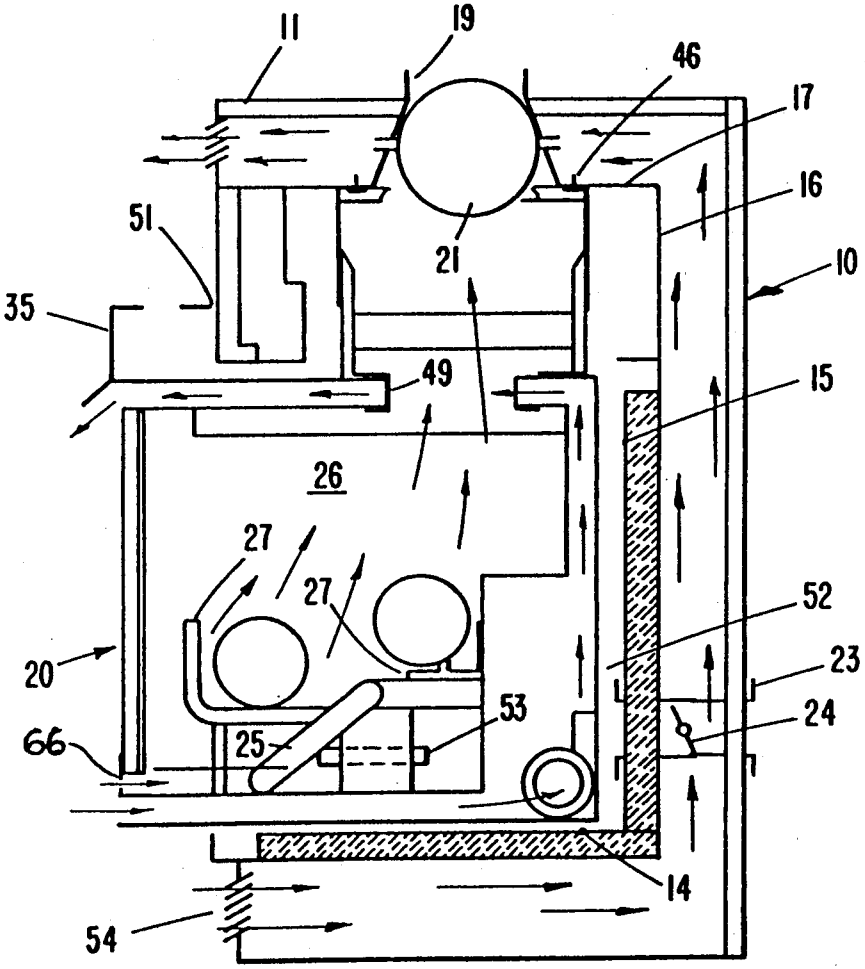
FIG. 4 is a schematic drawing in cross section showing the novel gas conversion kit of FIG. 2 installed in the prior art wood burning fireplace of FIG. 1.
Figure 5:
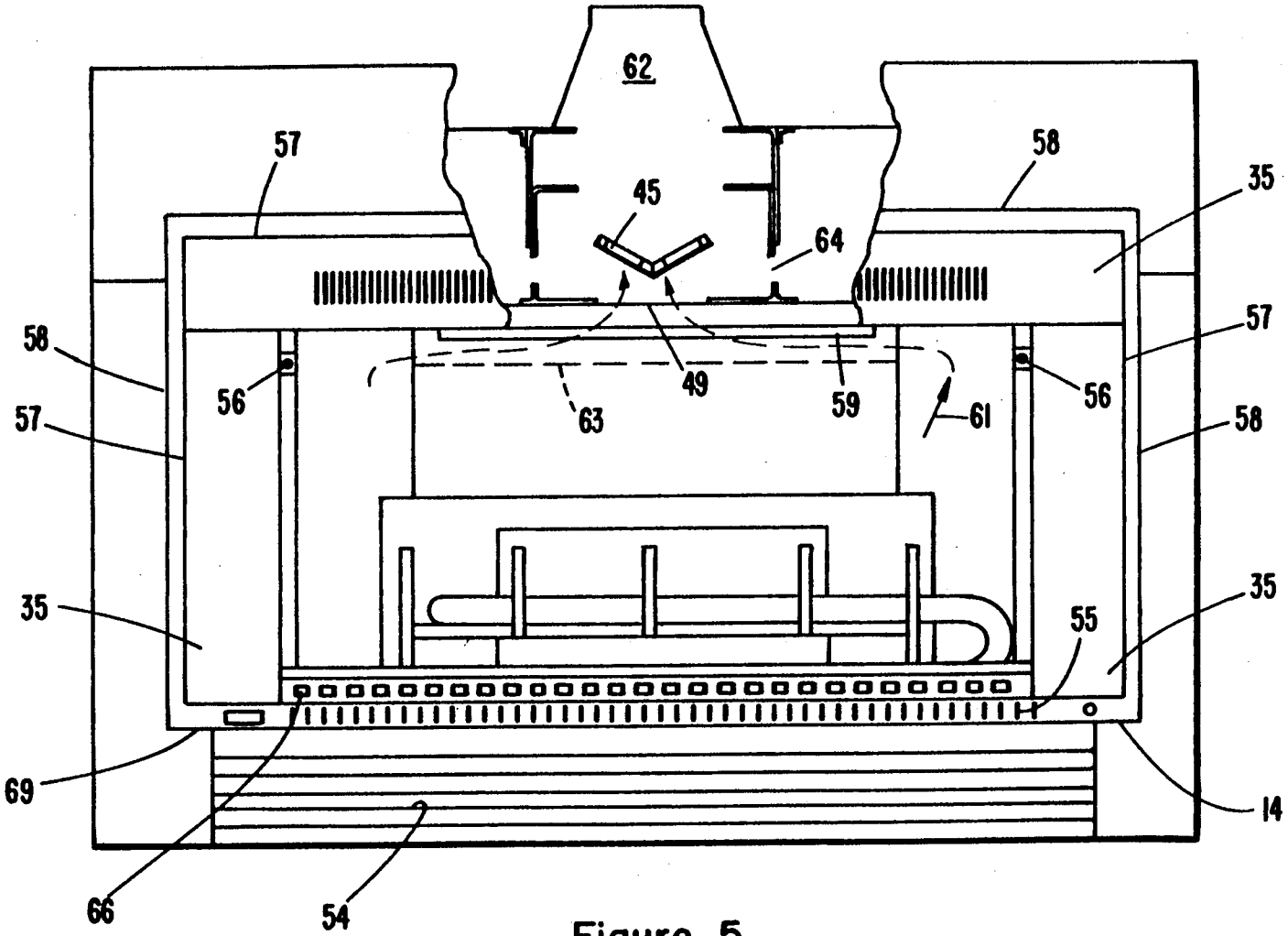
FIG. 5 is a front view in elevation of the assembled fireplaces of FIGS. 4 showing a partial section of the novel diverter coupler.

It will be understood that the diverter conversion unit 30 shown in FIG. 3 is a preferred embodiment shape and the same mode of operation may be accomplished by providing an upper cylindrical sleeve which fits over and cooperates with a lower cylindrical sleeve as shown in FIGS. 2, 4 and 5 which is provided with a V-shaped or conical shaped diverter. When there are holes, cutouts or apertures provided in the lower cylindrical sleeve, the same mode of operation and degree of down draft diversion can be obtained with a modified form of the preferred embodiment shown in FIG. 3.

Refer now to FIG. 4 showing in side elevation and cross section, the novel gas conversion kit of FIG. 2 installed in the prior art wood fireplace of FIG. 1. The proper and preferred method of installing the gas conversion unit 20 into the combustion area 13 of the prior art fireplace 10 is to remove the shroud 35 and remove the conversion unit 30. The top portion 37 of the conversion unit 30 is attached by screws 46 or other convenient means to the top wall 17 of the fireplace 10. Then the bottom portion 38 of the conversion unit 30 is telescopically fitted into the upper portion 37 and the fireplace unit 20 is slipped or slid into the combustion chamber 13 so that the ears or flange portions of 47 of the horizontal plate portion 48 of the lower portion 38 fit beneath the slide guides 36. Once the ears 47 are aligned with the guides 36, the unit 20 is slipped or slid into the combustion chamber 13 completing the coupling or connection of the exhaust outlet 49 of the gas conversion unit 20 to the top wall 17 of the prior art fireplace 10. In order to make this simple attachment, the fireplace unit is out of the way and removed when the upper portion 37 is attached to the top wall 17 and the shroud 35 is removed to provide visual access when aligning the slide guides 36 with the ears 47. After the gas conversion unit is fully in position, the gas lines are connected to the burner valve and appropriate electrical connections are provided for the blower.

Before the gas conversion unit 20 is positioned in its final operating position, the shroud 35 is attached to the front of the unit 20 by screws not shown. When the shroud is in place, it forms a open rectangle on the two sides and top and has a precision mounting edge which fits tight against the face of the prior art zero clearance fireplace which is being converted. It will be understood that air is capable of entering all around the three sides of the open rectangular shroud 35 and provides a cooling effect on the zero clearance fireplace at the sides and top.

The gas conversion unit 20 is shown having a rectangular slot 53 which extends through the side walls of the unit and interconnects with the dead air space 52 and the fresh air inlet 23. It will be understood that if a fresh air inlet 23 is not already provided, it is not necessary to utilize the rectangular slot 53 provided.

Having explained the function and elements of the components shown in FIG. 1 and 2, the same numbers have been applied to the same components in FIG. 4 and do not require further explanation at this time. In addition to the numbering system arrows showing the flow of the room air to be heated as well as the entrance of the combustion air have been superimposed on FIG. 4 for a better understanding of the novel conversion unit.

Refer now to FIG. 5 showing a front view of the novel gas conversion kit of FIG. 2 installed in the wood burning fireplace of FIG. 1. The grill 54 is the prior art entrance to the passageway 22A. The conversion unit 20 sits on the bottom wall 14 of the prior art fireplace 10. A decorative grill 55 of the gas conversion unit 20 extends the full width of the fireplace unit 20 and terminates at the outer boundary of the shroud 35. As will be explained hereinafter, the shroud 35 mounts into a slot in the bottom wall of the conversion unit 20 and is attached by screws 56 which extend through tabs on the shroud 35. The outer parameter of the decorative shroud 35 is represented by the numeral 57 and was designed and made smaller than the smallest opening 58 of all of the prior art zero clearance wood burning fireplaces which were examined for opening size and compatibility with the size of the novel gas conversion unit 20. Heated air leaving the aforementioned heat exchange passageway 32 passes under the deflection plate 59. Exhaust gas 61 attempting exit in the stack 62 is forced to pass around the deflector plate 63 before encountering the V-shaped diverter plate 45 which serves as a down draft diverter.

When an extreme down draft occurs in the stack 62, it encounters the diverter plate 45 and cannot enter directly into the exhaust port 49. The compressed air in the down draft diverter passes through the aperture 64 (shown schematically) and is baffled in the plenum area which exists above the gas conversion unit 20 and on the sides and back of the gas conversion unit. It cannot be compressed into the fire chamber and is free to pump out the dead air through the aperture 66 in the decorative shroud 35 until the down draft condition is overcome. Thus, the decorative shroud serves an additional purpose in that it provides damping of down draft conditions and forms a decorative mounting shroud that is deep enough to loosely fit inside of a opening in a prior art fireplace without creating high temperature effects on the zero clearance fireplace and is decoratively acceptable as an artistic edifice.

An ornamental combustion air inlet grill 66 is provided on the front face of the gas conversion unit 20. When the code requirements mandate that all fresh air must be used in the combustion chamber, then this closable ornamental combustion air inlet grill 66 is closed by closure means 66 as shown in FIG. 2 and the aforementioned fresh air inlet slots 53 which connected through the air space areas around the combustion unit 20 to the fresh air inlet 23 are employed to supply fresh air.

Figure 6:
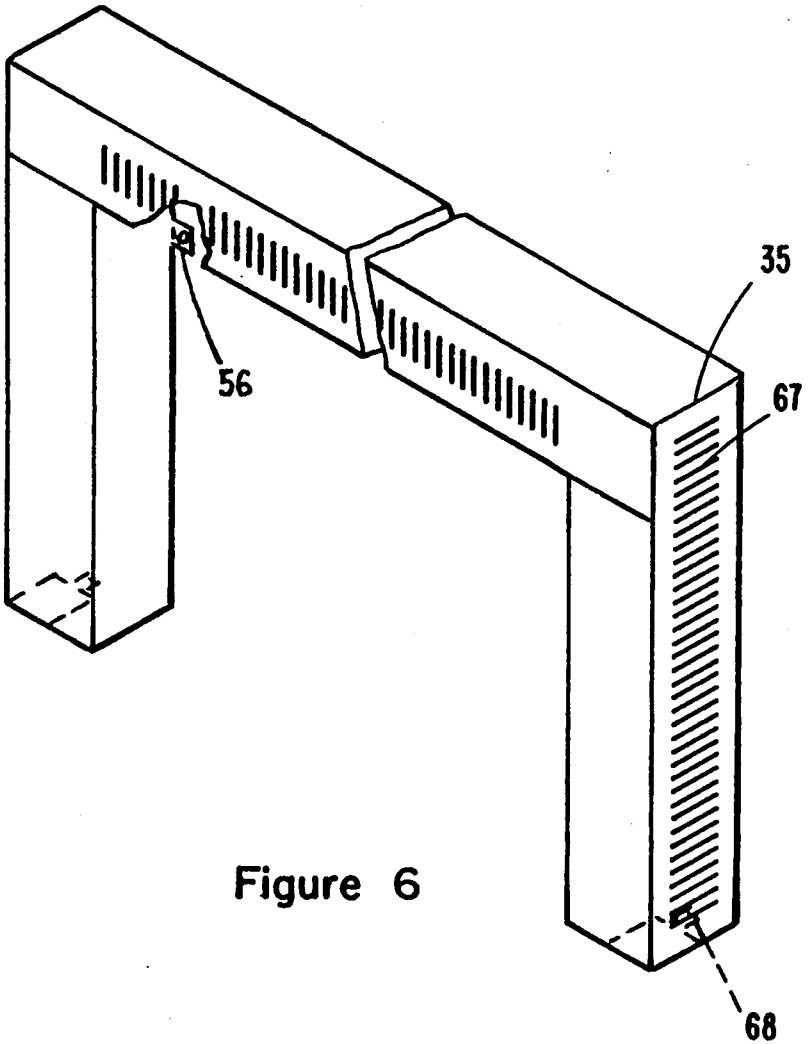
FIG. 6 is a side view in elevation of the novel decorative air bleed shroud which is mounted on the gas conversion fireplace to complete the gas conversion assembly.

Refer now to FIG. 6 which shows in side elevation the ornamental shroud or grill 35 having preferred shaped elongated slots 67 on all three sides. These slots are not provided and/or used in very cold climates where the shroud is fitted tightly to the existing fireplace. Two downward extending positioning tabs 68 are provided on the outer portions of the shroud 53 and are adapted to slip into slots in the bottom panel 69 of the gas conversion kit 20.

Figure 7:
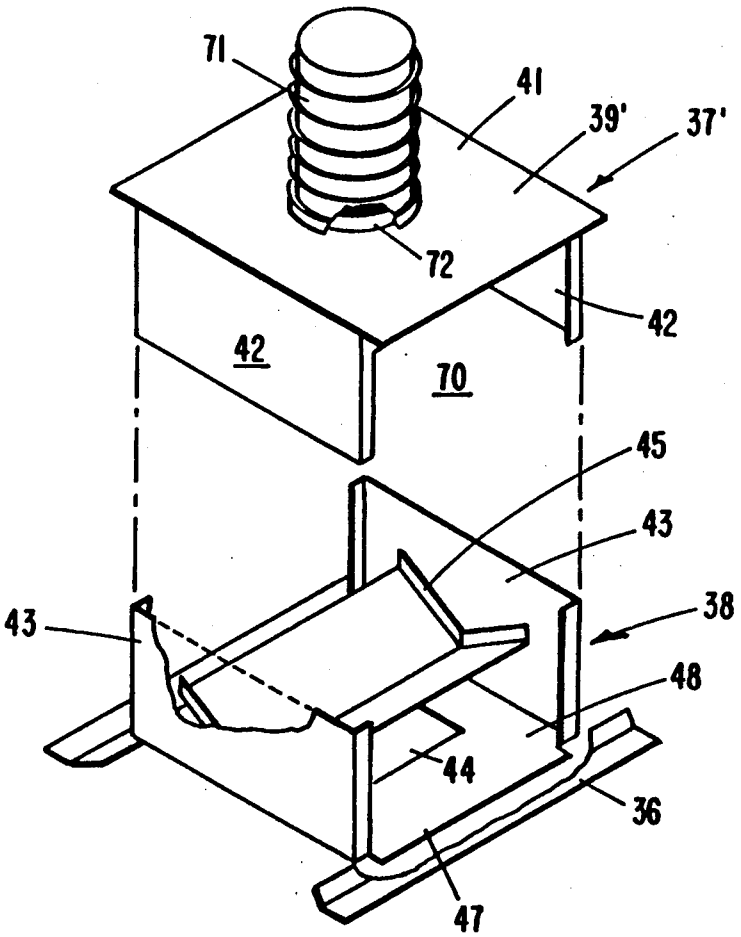
FIG. 7 is an enlarged isometric view of the novel draft diverter coupler of FIG. 3 modified to be quick coupled to an expanded insert chimney liner.

Refer now to FIG. 7 showing an enlarged isometric view of the novel draft diverter conversion unit 70 modified to be coupled to a commercially available expandable cylindrical chimney liner 71. The lower portion 38 is identical to that shown in FIG. 3 and is numbered with the same numerals. The upper portion 37' of the diverter unit comprises a horizontal flange portion 39', which is provided with a hollow annular collar 72 that extends coaxially into the expanded insert chimney liner 71. The downward extending flanges 42 fit slidably over upward extending flanges 43 of the lower portion 38. It will be appreciated that the preferred sequence of installation steps includes placement of the old or a new chimney liner 71 in place and fixed to the upper portion 37'. Upper portion 37' is first fixed to the chimney liner of fireplace 10 and then coupled to lower portion 38. The gas conversion unit 20 is then moved into place in unit 10 and slidably coupled to unit 38.

Having explained a preferred embodiment insertable gas conversion unit for a prior art wood burning zero clearance fireplace, it will be appreciated that the furnace and combustion chamber of the present conversion unit employ features of our aforementioned U.S. Pat. No. 4,793,322 and also embody new features and structure for the installation of the conversion unit in wood burning fireplaces which was not available heretofore. The conversion unit comprises a down draft diverter conversion unit 30 which can be installed prior inserting to the gas conversion unit and includes a decorative shroud which hides or conceals the opening of the prior art wood burning fireplace. The novel conversion unit comprises a highly efficient gas conversion unit which has been represented and explained with reference to only a wood burning zero clearance fireplace conversion. The same unit explained in FIG. 2 may be installed in old prior art masonry fireplaces by using a different shroud and down draft diverter which is adapted to fit into the existing chimney of old homes.

Having explained how the novel down draft conversion unit can be employed for rapidly coupling gas conversion units to existing prior art zero clearance wood burning fireplaces, it will be understood and appreciated that the diverter element 38 placed in the down draft conversion unit may be moved into the top wall of the gas conversion unit at the expense of reducing the size of the combustion chamber 26 and also reducing the height of the viewing area of the decorative gas conversion unit provided by the ceramic glass panel 33. Further, when the diverter is moved into the top wall of the gas conversion unit 20, there is required a diverter passageway which further complicates and adds to the expense of the gas conversion unit.

What is claimed is:

1. A gas fireplace conversion unit adapted to be inserted into a previously installed existing wood burning fireplace, having a exhaust outlet, to provide a gas burning fireplace conversion unit, comprising:

an insertable gas fireplace conversion unit adapted to be mounted inside the combustion chamber of an existing fireplace at a user's site without custom fitting, said gas conversion unit having a fire fox combustion chamber, an exhaust gas outlet in the top of said fire box and a gas burner mounted in said firebox combustion chamber, decorative glass door means mounted on said gas conversion unit covering the front of said gas fireplace combustion chamber, down draft diverter means mounted on top of said fire box over said exhaust gas outlet, said down draft diverter means comprising:

first coupling means for connection to the exhaust outlet of an existing wood burning fireplace, second coupling means connected to said exhaust gas outlet of said fire box of said combustion chamber of said gas conversion unit, and vertical guide means on said first and said second coupling means having side openings for telescopingly fitting said first coupling means into said second coupling means whereby said gas fireplace conversion unit is rapidly connected to a wood burning fireplace through the interconnection of said coupling means without custom fitting of said gas fireplace conversion unit into said existing wood burning fireplace.

2. A gas fireplace conversion unit as set forth in claim 1 which further includes a decorative shroud mounted on the front of the fireplace conversion unit and for mounting tight against an existing wood burning fireplace.

3. A gas fireplace unit as set forth in claim 1 which further includes a down draft diverter plate in said down draft diverter means mounted in one of said coupling means for diverting down drafts of air pressure through said side openings in said vertical guide means and from entering said combustion chamber and extinguishing said gas burner.

4. A gas fireplace unit as set forth in claim 1 wherein said first and said second coupling means are rectangular in shape and provided with vertical extending flanges which telescopingly fit one into the other.

5. A gas fireplace unit as set forth in claim 1 wherein said first coupling means and said second coupling means are cylindrically shaped and nest one inside of the other.

6. A gas fireplace unit as set forth in claim 3 which further includes a second diverter plate in said fire box combustion chamber directly below said down draft defector.

7. A gas fireplace unit as set forth in claim 1 wherein there is further provided a pair of slide guides mounted on top of said insertable gas fireplace conversion unit for receiving and connecting and adjustably centering said second coupling means to the exhaust gas outlet of said fire box combustion chamber.

8. A gas fireplace unit as set forth in claim 7 wherein said second coupling means are further provided with horizontally extending ears which cooperate with said slide guides for adjustably connecting said second coupling means to the exhaust gas outlet of said fire box combustion chamber of said conversion unit.

9. A gas fireplace unit as set forth in claim 1 including means forming a fresh air inlet in an existing wood burning fireplace, and said firebox combustion chamber of said conversion unit is further provided with apertures in the side of said fire box combustion chamber for introducing fresh air into the combustion chamber of said fireplace conversion unit.

10. A gas fireplace unit as set forth in claim 2 which further includes a precision mounting flange on said decorative shroud for mounting against an existing wood burning fireplace.

11. A gas fireplace unit as set forth in claim 10 wherein said decorative shroud is further provided with positioning tabs for mounting in slots further provided in said insertable gas fireplace conversion unit.

12. A gas fireplace unit as set forth in claim 11 wherein said decorative shroud is further provided with attachment tabs for mounting said decorative shroud on said insertable gas fireplace conversion unit.

13. A gas fireplace unit as set forth in claim 1 wherein said insertable gas fireplace conversion unit is nestable inside of the combustion chamber of existing wood burning fireplace and further provided a dead air space therebetween, fresh air inlet means coupled to said dead air space between said insertable gas fireplace and said existing wood burning fireplace, and fresh air slots in the side wall of said insertable gas fireplace conversion unit for conducting fresh air in said air space directly into said combustion chamber of said conversion unit.

14. A gas fireplace unit as set forth in claim 13 which further includes a closable combustion air inlet grill on the front of said insertable gas fireplace unit and closure means which may be closed when fresh outside combustion air is being introduced into the combustion chamber of said conversion unit.

15. A gas fireplace unit as set forth in claim 1 wherein said first coupling means further includes a horizontal flange portion having damper slot means therein adapted to receive a damper therethrough.

16. A gas fireplace unit as set forth in claim 1 wherein said first coupling means further includes a horizontal flange portion having collar means thereon adapted to connect to a fabricated chimney liner.

17. A gas fireplace unit as set forth in claim 16 wherein said collar comprises cylindrical extension means adapted to fit coaxially into said fabricated chimney.

18. A gas fireplace unit as set forth in claim 17 which further includes an expandable cylindrical chimney liner.

* * * * *